US005956774A

United States Patent [19]

Mackley

[11] Patent Number: 5,956,774

[45] Date of Patent: Sep. 28, 1999

[54] SIT-UPON SHORTS

[76] Inventor: Mary Beth Mackley, P.O. Box 8902, Asheville, N.C. 28814

[21] Appl. No.: 08/405,385

[22] Filed: Mar. 15, 1995

Related U.S. Application Data

[63] Continuation of application No. 08/191,114, Feb. 3, 1994, abandoned.

[51] Int. Cl.[6] ..... A41D 13/00

[52] U.S. Cl. ..... 2/227; 2/228; 2/238; 2/69

[58] Field of Search ..... 2/227, 228, 238, 2/237, 46, 69, 51, 81, 82, 79, 80, 2

[56] References Cited

U.S. PATENT DOCUMENTS

| | | | |
|---|---|---|---|
| 1,329,119 | 1/1920 | George | 2/238 |
| 2,446,326 | 8/1948 | Guithues | 2/238 |
| 2,618,266 | 11/1952 | DeLeone | 2/238 |
| 4,310,929 | 1/1982 | Finlay | 2/238 |
| 4,894,869 | 1/1990 | Boll | 2/46 X |
| 4,993,077 | 2/1991 | Robison | 2/82 |

*Primary Examiner*—Gloria Hale

[57] ABSTRACT

A shorts type garment, being joined and secured on the body of a wearer with closure flaps that are easily released at the hip and waist areas. The garment protects the buttocks area from environmental elements and is easily carried and donned. The garment comprises at least two layers. The outer layer acts as the primary barrier between the environmental elements and the wearer of the garment, especially providing protection from moisture. There is at least one inner layer to the garment, which can serve in a way to provide additional protection from environmental elements. This shorts type garment provides the wearer of the garment a means to adjust the garment for an appropriate fit.

7 Claims, 5 Drawing Sheets

SIT-UPON SHORTS

This application is a continuation of application Ser. No. 08/191,114 filed Feb. 3, 1994 Now abandoned.

BACKGROUND OF THE INVENTION

1. Field of the Invention

The present Invention relates in general to a shorts type garment and in particular to a shorts type garment providing protection from environmental elements.

2. Prior Art

In participating in many outdoor activities of sport and leisure, nature presents conditions proving adverse and antagonistic to comfort and enjoyment. Moisture is especially a problem, particularly for the buttocks. Many participants in outdoor activities of sport and leisure must contend with a cold, wet seat area due to environmental elements. Traditionally, this has been addressed with pants like foul weather gear as an outer, protective garment. At times, this type garment can be inconvenient: difficult to don, awkward to carry, and unnessessarily covers the entire legs, when only the buttocks needs protection. No garment is known, however, as a shorts type garment, easily applied as an outer layer by fastening the shorts closed and not having to step into them. It is desireable to have a protective type of outer garment, shorts like in nature, easily fastened, and providing a protective barrier against environmental elements.

U.S. Pat. No. 5,003,634 to Brinkman discloses a belt type garment: secured by two straps at the waist, with a waterproof, flexible panel stored in a zippered pouch. However, the present invention distinguishes therefrom as it is a shorts type garment ready to apply and wear to provide protection from environmental elements.

U.S. Pat. No. 4,925,241 to Geraci et al discloses a portable cushion apparatus; however, the present invention distinguishes therefrom as it is to be worn on the body to provide protection from environmental elements.

U.S. Pat. No. 5,067,175 to Gold discloses a padded garment for covering a body part—portions of gloves, sweaters, pant legs and boots. However, the present invention distinguishes therefrom as it is targeted to protect the buttocks area from environmental elements. The prior invention does not function in the manner as the present invention.

U.S. Pat. No. 4,842,330 to Jay discloses a protective seat cushion which has an attached body engaging sling and dished out central portion filled with fluid to be a seat cushion. However, the present invention distinguishes therefrom as it is actually a garment to be worn offering protection from environmental elements. The prior invention was abandoned.

U.S. Pat. No. 4,949,887 to Holmes discloses an insulated multi-use seat cushion with closeable hand and foot openings. However, the present invention distinguishes therefrom as it is specifically a shorts type garment to be worn, offering protection from environmental elements. The prior invention was abandoned.

Whatever the precise merits, features and advantages of the above cited references, none of them achieves or fulfills the purposes of the Sit-Upon Shorts.

SUMMARY OF THE INVENTION

The principal object of the present invention is to provide a protective shorts type garment for the buttocks area in that it is protected from environmental elements for use in all outdoor activities of sport and leisure.

It is also an object of the present invention to provide such a garment which is of simple and inexpensive construction.

Another object is to provide such a garment that can be carried without difficulty to be easily donned.

A further object is to provide such a garment which, in use, will increase enjoyment and pleasure by keeping the buttocks area protected from environmental elements encountered.

The foregoing objects can be accomplished by providing a shorts like type of garment easily applied, especially over other garments and fastened in place with recloseable flaps which can be found to fasten at the hip and waist areas of the wearer. In the preferred embodiment of the invention, the standard is formed by a shorts type garment comprising an outer surface preventing penetration of environmental elements through exterior of garment. The garment is easily applied over garments already worn and proceeds to cover the buttocks area. At least one layer of an insulating type material will lie underneath the exterior barrier material. An interior lining may enclose an insulating material between the outer surface material and the lining. The lateral edges of the garment joining at either side of the waist and hip areas contain a fastening agent, for example, a hook and loop fastener. Elasticity can be provided at the horizontal edges of the garment enclosing the waist with a resilient cord like material, for example, elastic.

DETAILED DESCRIPTION

Figure 1:
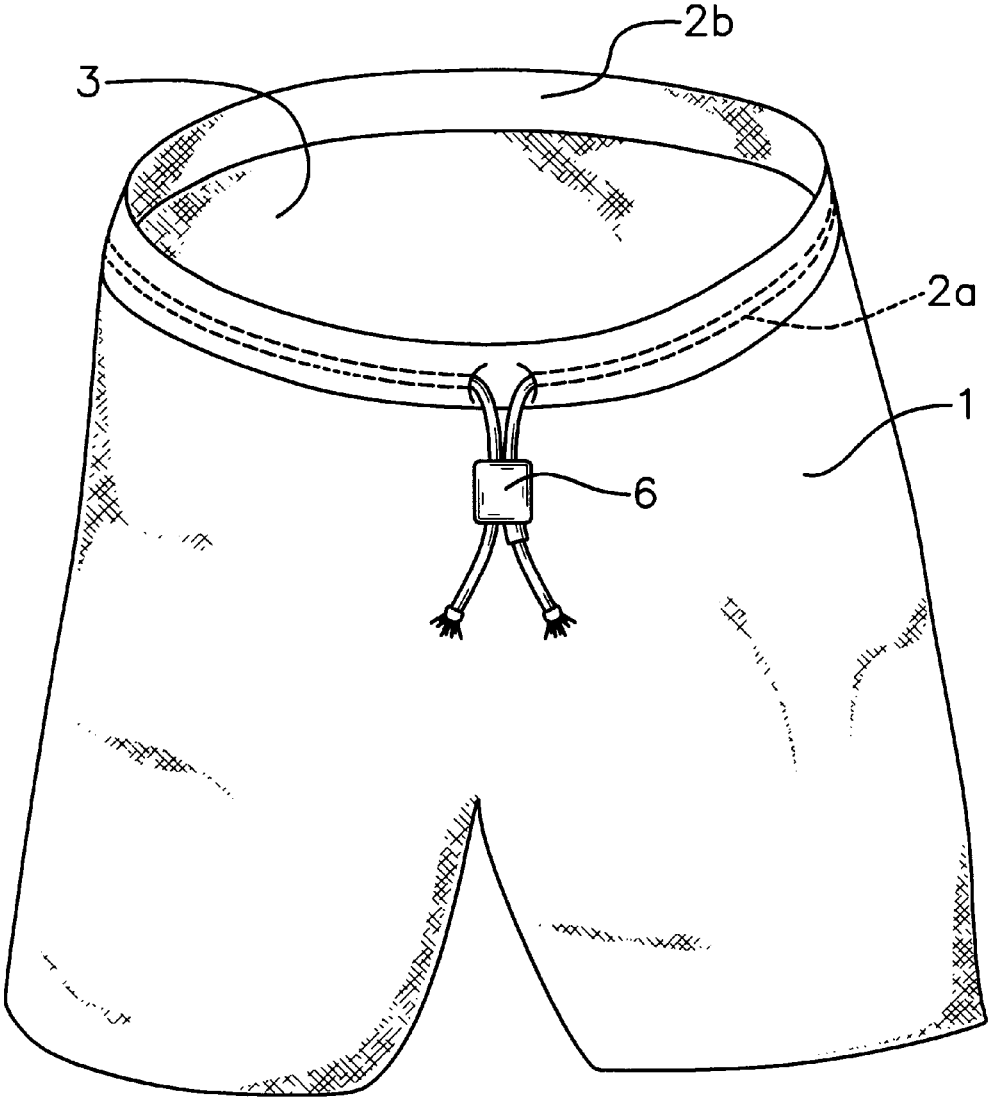
FIG. 1 is a perspective, front view of shorts type garment, fastened at the sides by recloseable flaps.
Figure 2:
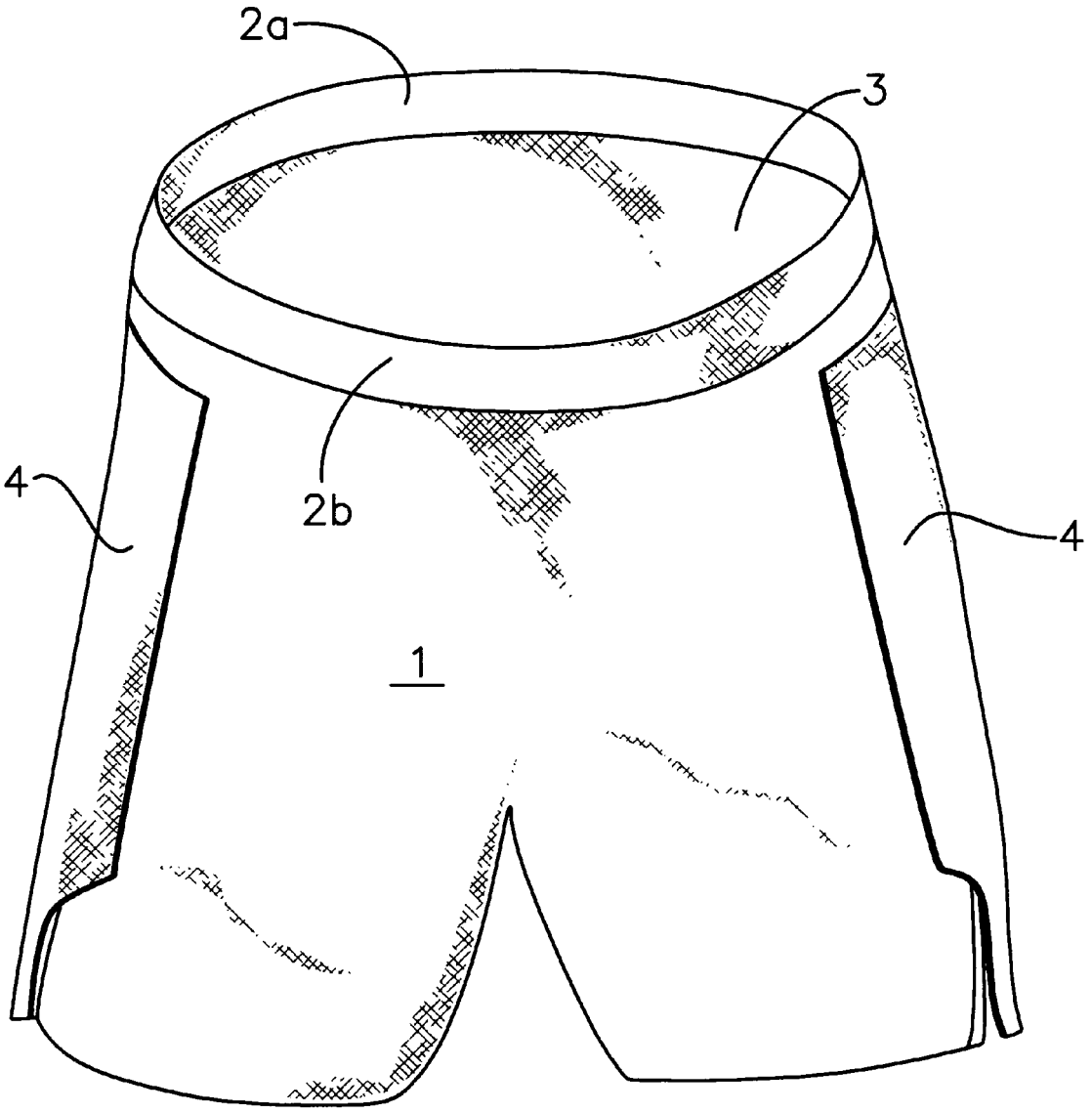
FIG. 2 is a perspective rear view of shorts type garment, fastened at the sides by recloseable flaps.
Figure 3:
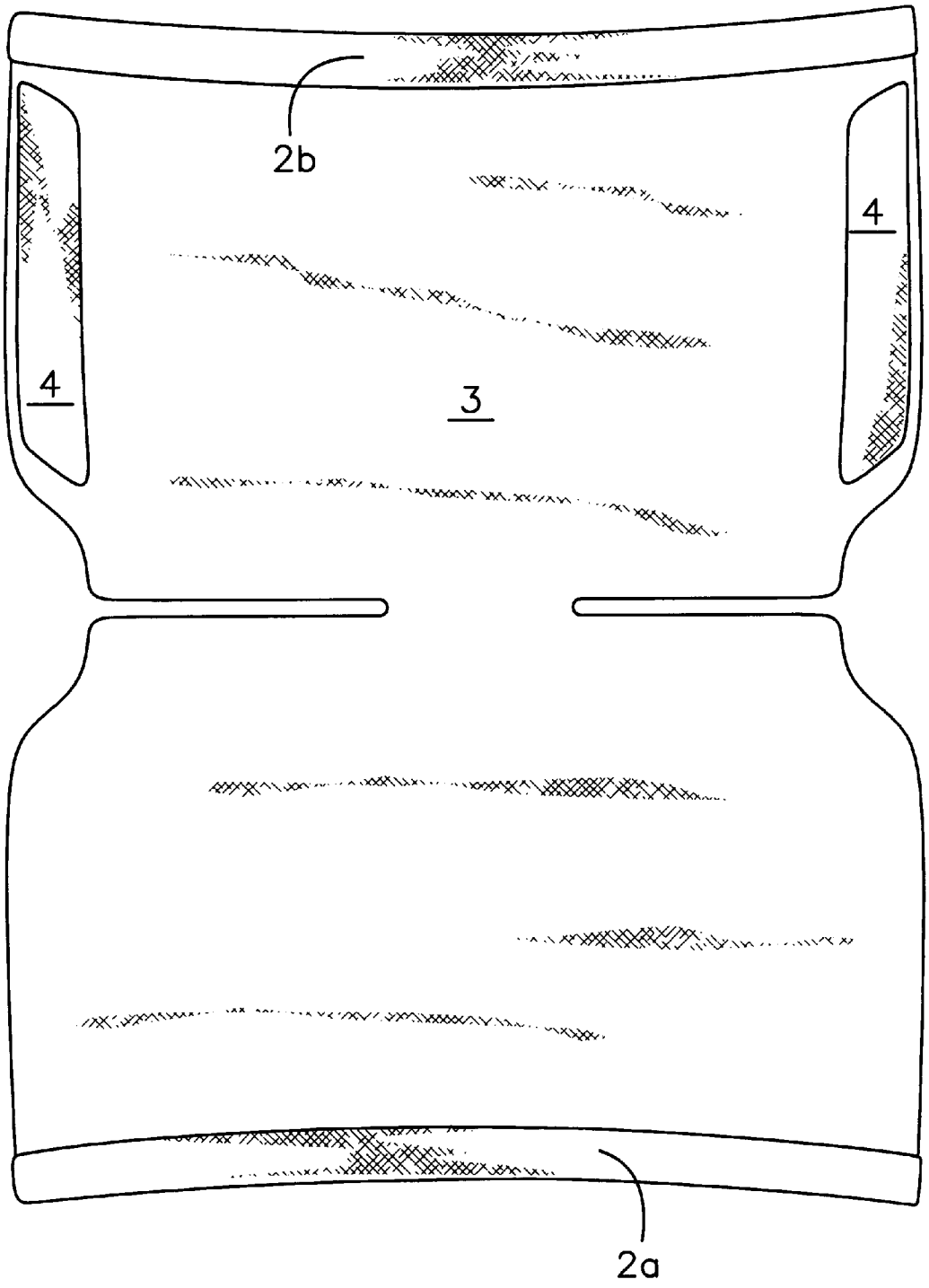
FIG. 3 is a perspective view of shorts type garment, unfastened at the sides, lying flat, and exposing interior surface of garment.
Figure 4:
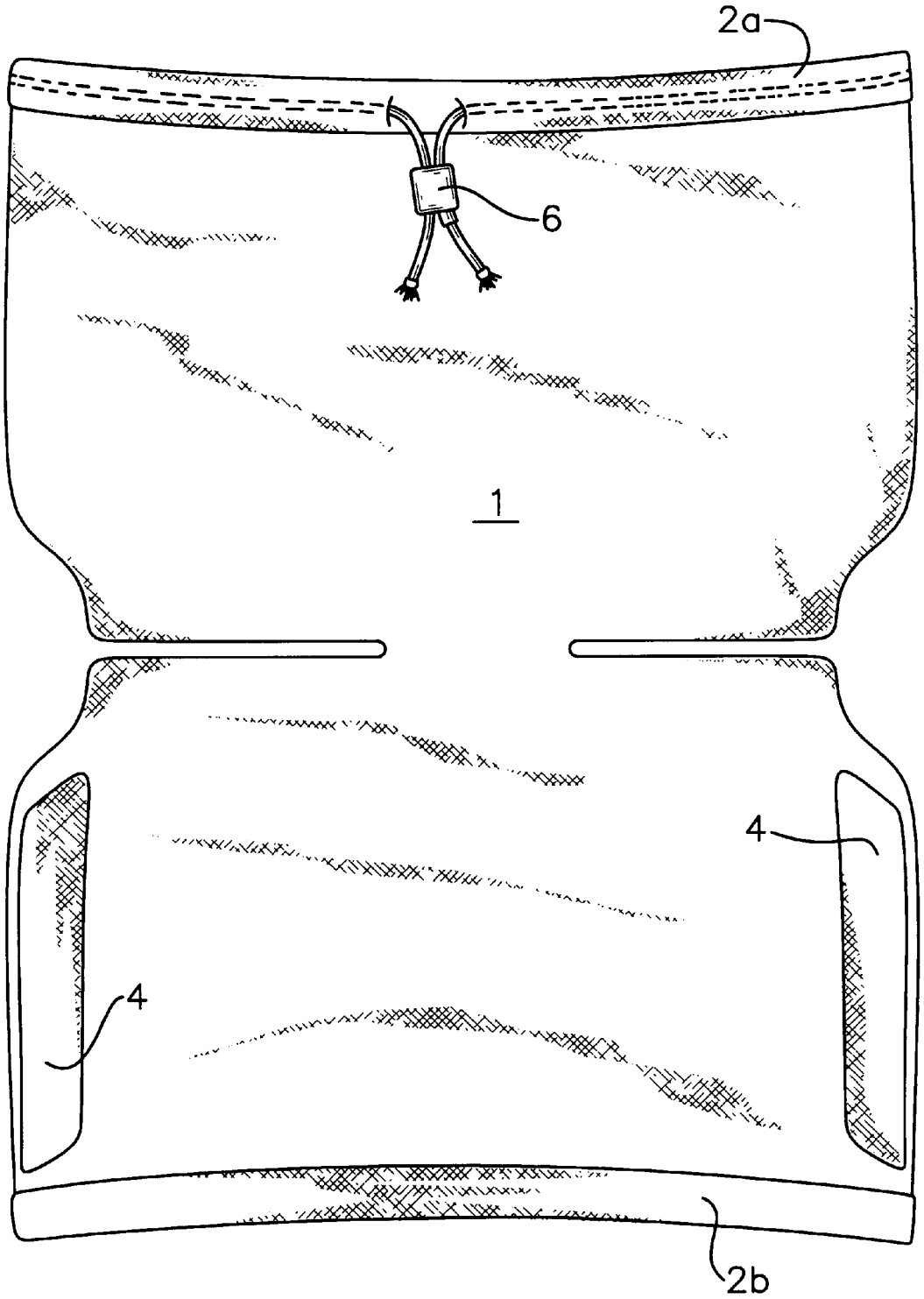
FIG. 4 is a perspective view of shorts type garment, unfastened at the sides, lying flat, and exposing exterior surface of garment.
Figure 5:
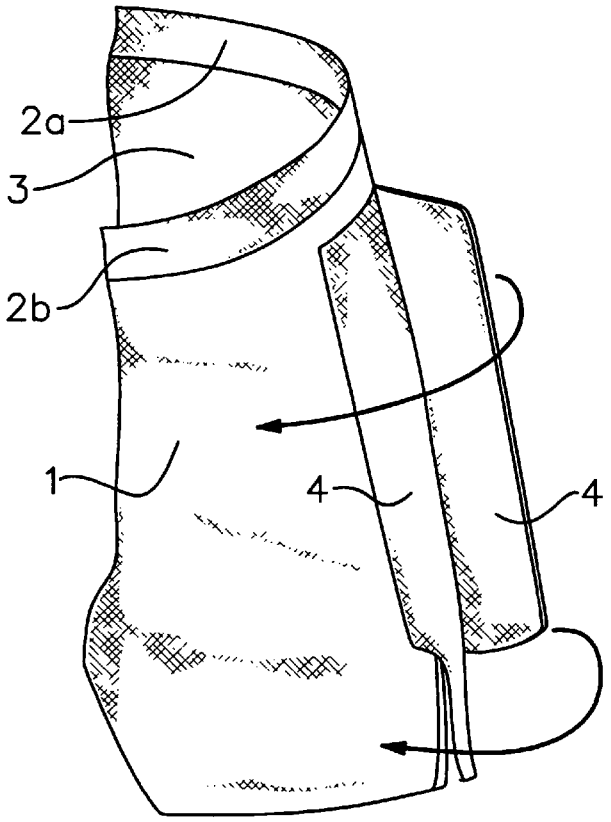
FIG. 5 is a fragmentary, rear perspective of shorts type garment fastened at right recloseable flap.
Figure 6:
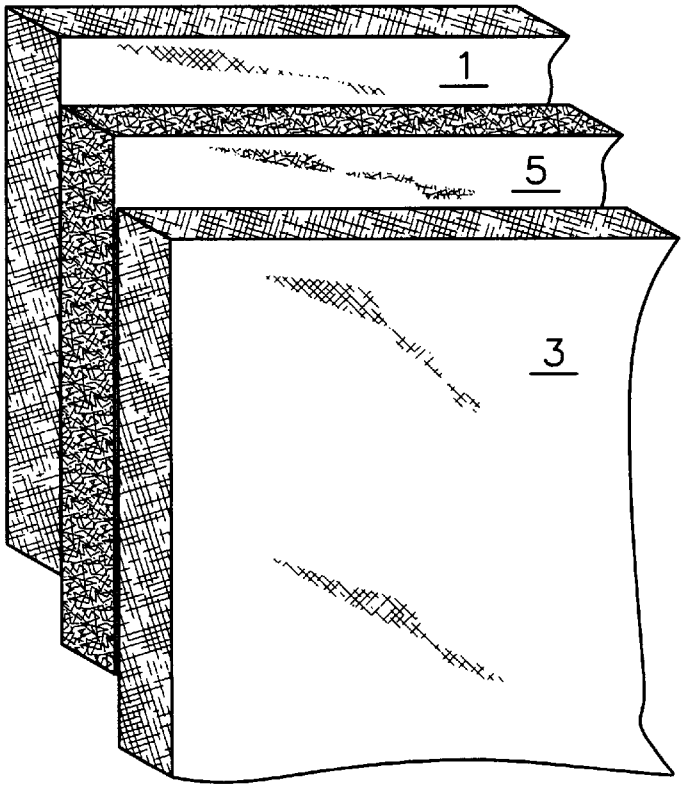
FIG. 6 is a cross-sectional view of three layers of material for preferred embodiment of shorts type garment.

As shown in the drawings, the preferred shorts type garment as a means for covering part of the body, in accordance with the present invention includes an outer garment panel 1 forming an outer, protective surface. FIG. 1 and FIG. 2 show the front and rear views of the garment respectively, as though it were being worn on the body and fastened at lateral sides of the wearer. This outer garment panel 1 preferably comprises a material that prevents moisture penetration. This is of particular importance in protecting the buttocks area from environmental elements. This outer garment panel 1 is an especially important panel in that it is the primary barrier between the environmental elements and the wearer of the garment. At least one inner garment garment panel 3 lies adjacent to the outer garment panel 1, and joining each other. The inner garment panel 3 is a type of lining and joins the outer garment panel 1 at respective seam locations, forming shorts type garment and providing additional protection to the buttocks area from environmental elements. This inner garment panel 3 could serve other purposes, including, but not exclusive of, wicking properties; the provision of easier movement at surface between Sit-Upon Shorts and wearer's clothes. The preferred embodiment of the invention has a third garment panel—a layer of insulating material 5 enclosed in the area between the outer garment panel 1 and the inner garment panel 3. This middle garment layer 5 is also joined at the same seam locations of outer garment panel 1 and inner garment panel 3, forming the shorts type garment. When the shorts type garment is donned, it is to be fastened on right hip and waist areas of the wearer and the left hip and waist areas of the wearer, by a pair of closure flaps 4 easily released and that can be repeatedly closed and opened on either side. Closing the flaps on right and left hip and waist areas, secures the garment on the body of the wearer. Encircling the waist area of wearer of shorts type garment, is a resilient cord like material 2*a* and 2*b*, for example, elastic. The garment is additionally secured to the body of the wearer by providing adjustment at the upper edges of the of the garment panels. The preferred embodiment of the invention has at the waist area of the front of the shorts type garment 2*a*, an adjustable, resilient cord like material to further secure the garment on the body of the wearer. This feature allows the wearer a means for gathering shorts type garment at the waist to provide additional fitting, as the wearer can loosen or tighten the waist. The cord like material 2*a* will have a means for adjustment, for example, a toggle type piece 6 as in the preferred embodiment of the invention. Other means of fastening the resilient cord like material at the waist area of the front of the shorts type garment 2*a*, may be applied. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A garment for protecting an already-clothed buttocks area of a wearer from environmental elements, said garment comprising:

an outer panel made of a material which forms a barrier against moisture penetration;

an inner panel made of a lining material;

said inner and outer panels being permanently joined at seams, and together defining a front primary flap and a rear primary flap joined by a crotch portion, said front and rear primary flaps each having left and right sides and having opposed top edges; and a pair of closure devices that can be repeatedly closed and opened for joining said left side of said front primary flap to said left side of said rear primary flap over the left hip and waist areas of the wearer and for joining said right side of said front primary flap to said right side of said rear primary flap over the right hip and waist areas of the wearer, such that said top edges together define a garment waist.

2. The garment of claim 1, wherein said closure devices comprise closure flaps.

3. The garment of claim 1, which further comprises a resilient waist cord.

4. The garment of claim 1, which further comprises an intermediate panel of thermal insulation material between said inner and outer panels.

5. The garment of claim 1, wherein said lining material of said inner panel has wicking properties.

6. The garment of claim 1, wherein said lining material of said inner panel facilitates relative movement between said garment and the wearer's clothes.

7. The garment of claim 1, which further comprises an adjustable drawstring within said top edge of at least said top edge of said front from primary flap.

* * * * *